United States Patent [19]

Flick et al.

[11] Patent Number: 4,554,423

[45] Date of Patent: Nov. 19, 1985

[54] MOLDED CASE CIRCUIT BREAKER WITH ADJACENT POLE MECHANISMS SPACED CLOSER THAN ADJACENT TERMINALS

[75] Inventors: Robert H. Flick, Brighton Township, Beaver County; Lawrence D. Dennis, Henry Clay Township, Fayette County, both of Pa.

[73] Assignee: Westinghouse Electric Corp., Pittsburgh, Pa.

[21] Appl. No.: 569,057

[22] Filed: Jan. 9, 1984

[51] Int. Cl.[4] ..... H01H 9/00

[52] U.S. Cl. ..... 200/293

[58] Field of Search ..... 200/153, 286, 287, 293, 200/303, 249, 250, 251, 284, 245, 246

[56] References Cited

U.S. PATENT DOCUMENTS 2,008,068 7/1935 Gaynor ..... 200/293

2,302,395 11/1942 Seaman ..... 200/293

2,926,225 2/1960 Aquillon ..... 200/68.2

3,632,939 1/1972 Yorgin ..... 200/293

*Primary Examiner*—John W. Shepperd

*Attorney, Agent, or Firm*—M. S. Yatsko

[57] ABSTRACT

A molded case circuit breaker includes first and second pairs of separable electrical connectors disposed in adjacent poles of the circuit breaker and spaced apart by a spacing less than the spacing between externally extending electrical terminals for making external electrical connections to the same adjacent poles of the circuit breaker. The closer spacing is achieved by a plurality of integrally formed, molded projections formed in the base of the molded case of the circuit breaker for positioning movable portions of the lower electrical contacts spaced apart in the base by the above closer spacing.

29 Claims, 3 Drawing Figures

MOLDED CASE CIRCUIT BREAKER WITH ADJACENT POLE MECHANISMS SPACED CLOSER THAN ADJACENT TERMINALS

CROSS REFERENCE TO RELATED APPLICATIONS

The invention disclosed herein relates to molded case circuit breakers. The inventions disclosed in the following four commonly assigned U.S. patent applications also relates to molded case circuit breakers: U.S. patent application Ser. Nos. 440,680; 440,681; 440,682; and 440,683, all of which were filed on Nov. 10, 1982. In addition, commonly assigned U.S. patent application Ser. No. 450,857 filed on Dec. 17, 1982 also relates to molded case circuit breakers.

The following six commonly assigned U.S. patent applications were all filed in the U.S. Patent and Trademark Office on Dec. 19, 1983 and relate to molded case circuit breakers: Ser. No. 562,647 filed by Alfred E. Maier and entitled Molded Case Circuit Breaker With An Apertured Molded Cross Bar For Supporting A Movable Electrical Contract Arm; Ser. No. 562,643 filed by Robert H. Flick and Walter K. Huffman and entitled Molded Case Circuit Breaker With Movable Upper Electrical Contact Positioned By Tension Springs; Ser. No. 562,648 filed by Robert H. Flick and Walter K. Huffman and entitled Molded Case Circuit Breaker With Improved Operating Mechanism; Ser. No. 562,664 filed by Alfred A. Maier and entitled Molded Case Circuit Breaker With Adjustable Stationary Lower Electrical Contact; Ser. No. 562,602 filed by Robert H. Flick and Walter K. Huffman and entitled Molded Case Circuit Breaker With Movable Lower Electrical Contact; and Ser. No. 562,603 filed by Robert H. Flick and Walter K. Huffman and entitled Molded Case Circuit Breaker With Movable Upper Electrical Contact Positioned By Torsion Springs.

Finally, the following five commonly assigned U.S. patent applications were filed in the U.S. Patent and Trademark Office on Jan. 9, 1984 the same day as this patent application and relate to molded case circuit breakers: Ser. No. 569,059 filed by Alfred E. Maier and entitled Molded Case Circuit Breaker With With Cross Bar Stop Molded In Base Of Case; Ser. No. 569,058 filed by Dante Bagalini and entitled Molded Case Circuit Breaker With Resettable Combined Undervoltage And Manual Trip Mechanism; Ser. No. 569,056 filed by Kurt A. Grunert and Joseph F. Changle and entitled Molded Case Circuit Breaker With Handle Lock; Ser. No. 569,055 filed by Joseph J. Matsko, Kurt A. Grunert and Bruce R. Terhorst and entitled Solenoid Operator Circuit For Molded Case Circuit Breaker; and Ser. No. 569,054 filed by Kurt A. Grunert and Walter K. Huffman and entitled Molded Case Circuit Breaker With Single Solenoid Operator For Rectilinear Handle Movement.

BACKGROUND OF THE INVENTION

A. Field of the Invention

The device of the present invention generally relates to molded case circuit breakers and, more particularly, to structural components thereof configured to provide dimensionally small, sturdy and effective electrical circuit breakers.

B. Description of the Prior Art

Circuit breakers and, more particularly molded case circuit breakers are old and well known in the prior art.

Examples of such devices are diclosed in U.S. Pat. Nos. 2,186,251; 2,492,009; 3,239,638; 3,525,959; 3,590,325; 3,614,685; 3,775,713; 3,783,423; 3,805,199; 3,815,059; 3,863,042; 3,959,695; 4,077,025; 4,166,205; 4,258,403; and 4,295,025. In general, prior art molded case circuit breakers have been provided with movable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized an operating mechanism having a trip mechanism for controlling the movement of an over-center toggle mechanism to separate a pair of electrical contacts upon an overload condition or upon a short circuit or fault current condition. Such trip mechanisms have included a bimetal movable in response to an overload condition to rotate a trip bar, resulting in the movement of the over-center toggle mechanism to open a pair of electrical circuit breaker contacts. Such prior art devices have also utilized an armature movable in response to the flow of short circuit or fault current to similarly rotate the trip bar to cause the pair of contacts to separate. At least some prior art devices use blow-apart contacts to rapidly interrupt the flow of high level short circuit or fault currents. In the design of small molded case polyphase circuit breakers, it is often desirable to have adjacent pole mechanisms spaced closer than adjacent external electrical terminals. Among other advantages, the closer spacing of adjacent pole mechanisms enables thicker and stronger molded case walls to be used. Generally, to achieve the closer spacing of adjacent pole mechanisms, prior art devices used relatively wide lower electrical contacts to compensate for contact misalignment or used separate spacers for shifting the lower electrical contact carriers or used angularly disposed external electrical terminals to compensate for the contact misalignment.

While many prior art devices have provided adequate protection against fault conditions in an electrical circuit, a need exists for dimensionally small molded case circuit breakers capable of fast, effective and reliable operation and, more specifically, for components thereof that provide closer spacing between adjacent pole mechanisms than between adjacent electrical terminals without resorting to the disadvantageous measures referred to hereinabove.

SUMMARY OF THE INVENTION

An object of the present invention is to provide a new and improved circuit breaker.

Another object of the present invention is to provide a new and improved molded case circuit breaker having components that effectively and inexpensively achieve closer spacing between adjacent pole mechanisms than between adjacent electrical terminals.

Briefly, the present invention relates to a molded case circuit breaker having a plurality of integrally formed molded projections formed in the base of the molded case of the circuit breaker for positioning components of adjacent lower electrical contacts in adjacent poles of phases of the circuit breaker spaced apart by a distance less than the distance between adjacent externally extending electrical terminals of the same adjacent poles of the circuit breaker. Each lower electrical contact includes a first rotatable pin movable both rotatably and laterally with respect to a lower, formed stationary member. The integrally formed molded projections each include a tapered or sloped upper surface for contacting the rotatable pin and for laterally shifting the rotatable pin with respect to the lower formed stationary member to achieve the closer spacing referred to above. Each rotatable pin is laterally held in position in each pole of the circuit breaker by its engagement with elongated vertically extending surfaces of the molded projections and/or contacting portions of the lower formed stationary members of the lower electrical contacts. In this manner, the base portion of the molded case of the circuit breaker may be made with thicker and stronger molded case walls. In addition, arc plates of greater cross sectional plate area may be used in an electrical arc chute and a larger arc extinguishing area may be provided in each pole of the circuit breaker.

BRIEF DESCRIPTION OF THE DRAWING

The above and other objects and advantages and novel features of the present invention will become apparent from the following detailed description of the preferred and alternative embodiments of a molded case circuit breaker illustrated in the accompanying drawing wherein.

DESCRIPTION OF THE PREFERRED EMBODIMENT

Figure 1:
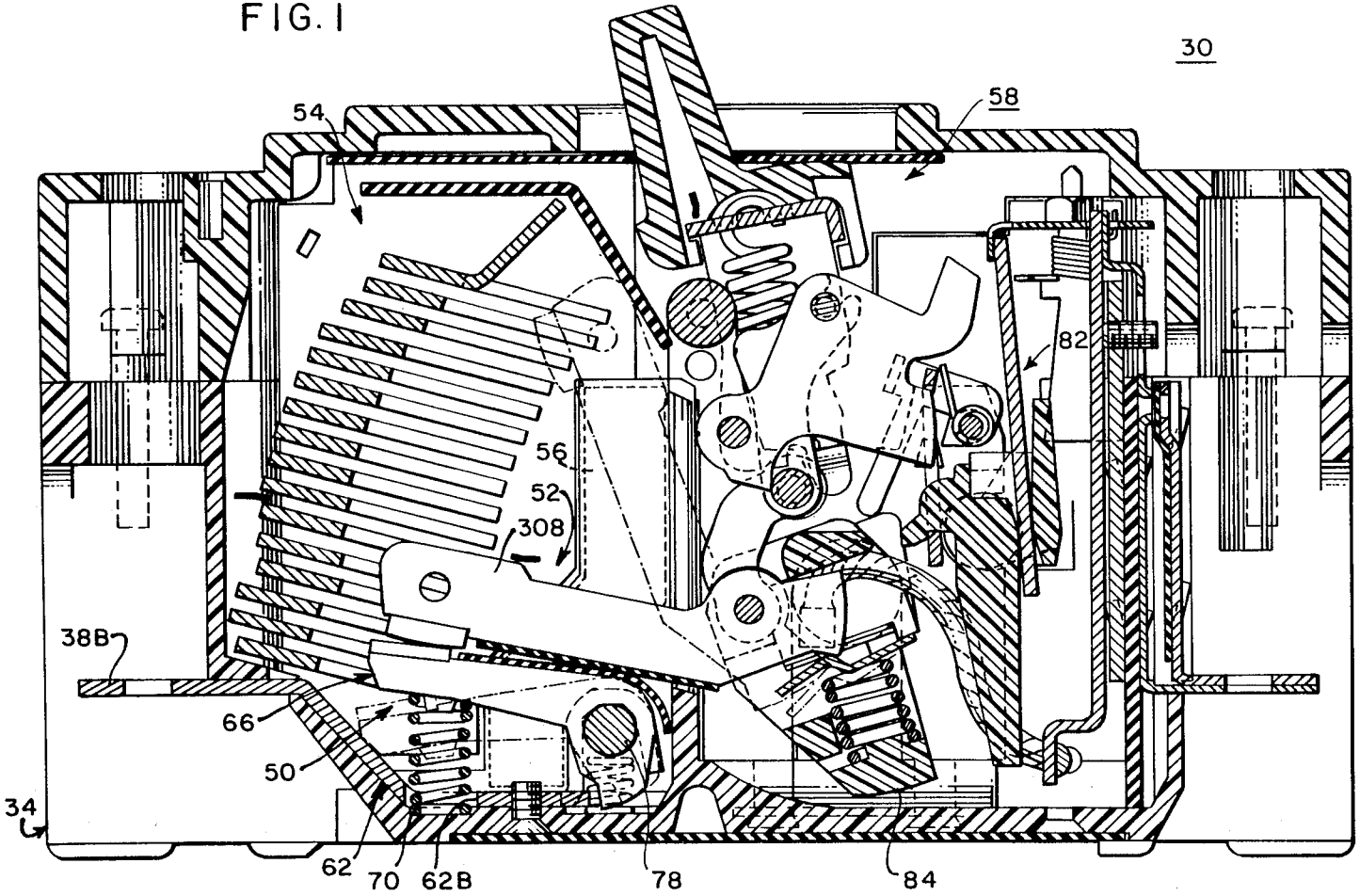
FIG. 1 is an enlarged, cross sectional view of a molded case circuit breaker according to the teachings of this invention, depicting the device in its CLOSED and BLOWN-OPEN positions.

The present invention is an improved molded case circuit breaker 30 (FIG. 1) of the type which includes upper and lower electrical contacts 52, 50, an arc chute 54, a slot motor 56, an operating mechanism 58 for moving the contacts 50, 52, and a trip unit 82 for initiating operation of the operating mechanism 58. A detailed description of such a circuit breaker 30 can be found from page 7, line 30 to page 27, line 26 of U.S. patent application Ser. No. 562,643, filed Dec. 19, 1983, which description is incorporated hereinto by reference.

Figure 2:
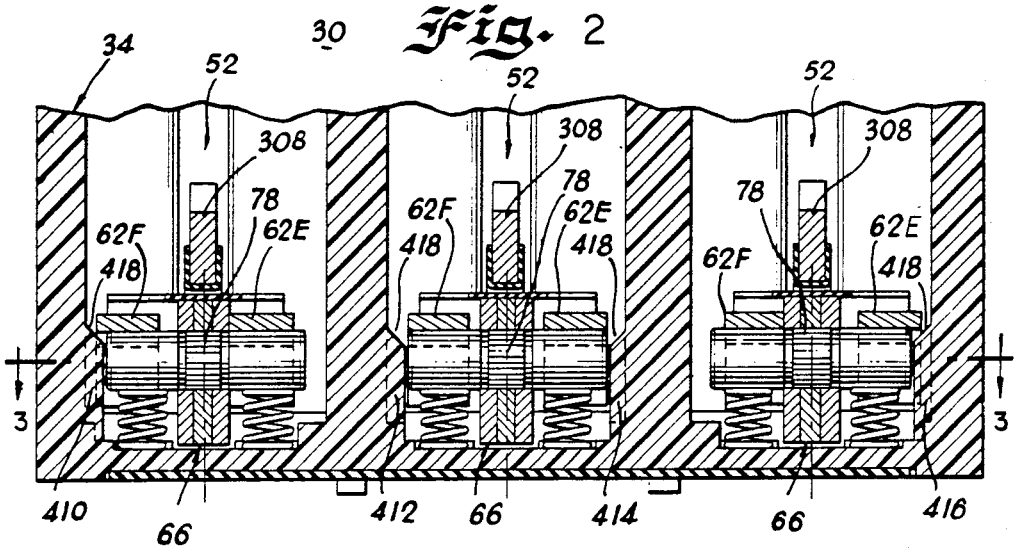
FIG. 2 is an enlarged, fragmentary, cross sectional view depicting the bottom cover or base of the device of FIG. 1.
Figure 3:
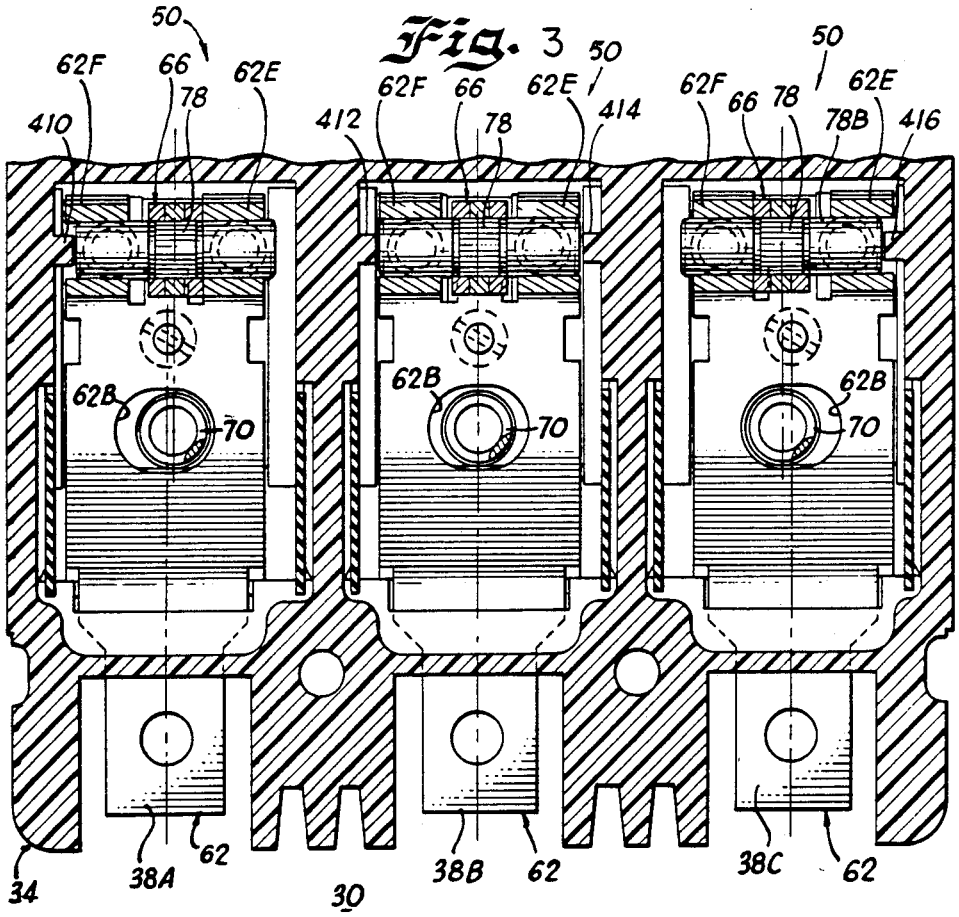
FIG. 3 is an enlarged, plan sectional view of the device of FIG. 2 taken along line 3—3 of FIG. 2.

In the present circuit breaker 30, the base 34 includes a plurality of integrally formed, molded projections 410, 412, 414 and 416, (FIGS. 2 and 3) each having a tapered or sloped upper surface 418 for properly and accurately positioning each rotatable pin 78 of each lower electrical contact 50 in each of the three poles or phases of the circuit breaker 30 to achieve closer spacing between adjacent pole mechanisms than the spacing between adjacent terminals 38A, B and C. More specifically, the spacing between the center lines of adjacent line terminals 38A, B and C (FIG. 3) is greater than the spacing between the center lines of adjacent pairs of contacts 50 and 52 disposed in adjacent poles of the circuit breaker 30. This closer spacing of adjacent pairs of the contacts 50 and 52 is inexpensively achieved and accurately determined and maintained by the engagement of the molded projections 410, 412, 414 and 416 with the rotatable pins 78 disposed in each pole of the circuit breaker 30. Since each rotatable pin 78 is capable of being shifted or moved laterally with respect to the contacting portions 62E and 62F, the contact arms 66, fixedly secured on the rotatable pins 78, in adjacent poles of the circuit breaker 30 may be spaced closer together than the corresponding line terminals 38, thereby to properly align each contact arm 66 with its associated and similarly closely spaced upper movable contact arm 308. Adjacent upper electrical contacts 52 are mounted in the cross bar 84 (FIG. 1) at the same relatively close spacing as compared to the spacing between adjacent line terminals 38. Sufficient clearance must be provided between the contact arms 66 and their respective contacting portions 62E and 62F in order to achieve the desired amount of lateral shift or movement of the rotatable pins 78 and the contact arms 66 in the outer poles of the circuit breaker 30 in the direction of the center pole of the circuit breaker 30.

When the lower electrical contact 50 associated with the outer pole of the circuit breaker 30 corresponding to the line terminal 38A is inserted in the base 34, the outward end of the rotatable pin 78 engages the tapered surface 418 of the molded projection 410 to gradually laterally shift or move the rotatable pin 78 by a predetermined desired amount along the tapered upper surface 418 in the direction of the center pole of the circuit breaker 30. When fully seated within that pole of the circuit breaker 30, the rotatable pin 78 is held against both a vertically extending surface of the molded projection 410 and the contact arm 66 is positioned against the contacting portion 62E thereby to retain the contact arm 66 laterally shifted in the direction of the center pole of the circuit breaker 30.

The molded projections 412 and 414 are symmetrical about the center line of the center pole mechanism of the circuit breaker 30 and their vertically extending surfaces bear against opposite longitudinal ends of the rotatable pin 78 to maintain the movable contact arm 66 positioned on the center line of the center pole mechanism and out of contact with the contacting portions 62E and 62F.

The molded projection 416 in the outer pole of the circuit breaker 30 associated with the line terminal 38C laterally shifts or moves the rotatable pin 78 toward the center pole of the circuit breaker 30. This lateral shifting is achieved in the same manner as described hereinabove with respect to the molded projection 410. However, the contact arm 66 in the pole of the circuit breaker 30 associated with the line terminal 38C is retained in position by the engagement of one longitudinal end of the rotatable pin 78 with a vertically extending surface of the molded projection 416 and by the engagement of the contact arm 66 with the contacting portion 62F.

To maintain proper alignment between respective pairs of electrical contacts 50 and 52 in each pole of the circuit breaker 30, the apertures 62B formed in the stationary member 62 of each lower electrical contact 50 are oblong to accommodate the closer spacings between adjacent compression springs 70 in adjacent poles of the circuit breaker 30 and to enable a particular lower electrical contact 50 to be used in any one of the poles of the circuit breaker 50.

In a specific embodiment of the present invention, adjacent pole mechanisms or pairs of electrical contacts 50 and 52 are spaced apart by approximately 1.328 inches while the spacing between adjacent line terminals 38 is approximately 1.375 inches. Thus, while the center lines of the line terminal 38B and of its associated pair of electrical contacts 50 and 52 are coincident, the center line of the line terminal 38A (FIG. 3) is located approximately 0.047 inch to the left or outwardly of the center line of its associated pair of electrical contacts 50 and 52. Correspondingly, the center line of the line terminal 38C is located approximately 0.047 inch to the right or outwardly of the center line of its associated pair of electrical contacts 50 and 52. In the same specific embodiment, the angle of the sloped or tapered upper surfaces 418 is approximately forty-five degrees.

Obviously, many modifications and variations of the present invention are possible in light of the above teachings. For example, if desired, an additional molded projection of desired thicknesses may be integrally formed on each inner surface of the outer pole portions of the base 34 to properly locate or position the rotatable pins 78 in the outer poles. Such molded projections would be configured to contact the longitudinal ends of the rotatable pins 78 opposite to the ends contacted by the molded projections 410 and 416. Thus, it is to be understood that, within the scope of the appended claims, the invention may be practiced otherwise than as specifically described hereinabove.

What is claimed and desired to be secured by Letters Patent is:

1. A polyphase electrical circuit breaker comprising:
a first electrical contact,
a second electrical contact,
a third electrical contact,
a fourth electrical contact,
said first and second electrical contacts being disposed in a first pole of said circuit breaker and being movable into a CLOSED position and into an OPEN position,
said third and fourth electrical contacts being disposed in a second pole of said circuit breaker and being movable into a CLOSED position and into an OPEN POSITION,
a first externally extending terminal of said circuit breaker electrically connected in said first pole of said circuit breaker,
a second externally extending electrical terminal of said circuit breaker electrically connected in said second pole of said circuit breaker,
a molded case for housing said circuit breaker, and
positioning means for locating said first and third contacts spaced apart by a distance less than the spacing between said first and second terminals, said positioning means comprising molded means for physically engaging said first contact, said molded means comprising an integrally formed portion of said case,
said first contact including first and second components movable relative to each other in the direction of said third and fourth contacts, said first component being configured for movement relative to said second component in the direction of said third and fourth contacts as the result of the physical engagement of said first component by said integrally formed portion of said case.

2. A polyphase electrical circuit breaker as recited in claim 1 wherein said third contact includes third and fourth components configured for movement relative to each other.

3. A polyphase electrical circuit breaker as recited in claim 2 wherein said first and third components are rotatably movable, respectively, with respect to said second and fourth components.

4. A polyphase electrical circuit breaker as recited in claim 2 wherein said positioning means further comprises second and third molded means for physically engaging said third contact, said second and third molded means respectively comprising second and third integrally formed portions of said case.

5. A polyphase electric circuit breaker as recited in claim 4 wherein said first mentioned integrally formed portion of said case includes a first sloped portion for physically engaging said first component and for moving said first component with respect to said second component in the direction of said third and fourth contacts.

6. A polyphase electrical circuit breaker as recited in claim 5 wherein said second integrally formed portion of said case includes a second sloped portion for physically engaging said third component and for moving said third component relative to said fourth component in the direction of said third integrally formed portion of said case.

7. A polyphase electrical circuit breaker as recited in claim 6 wherein said third integrally formed portion of said case includes a third sloped portion for physically engaging said third component and for moving said third component relative to said fourth component in the direction of said second integrally formed portion of said case.

8. A polyphase electrical circuit breaker as recited in claim 4 further comprising
a fifth electrical contact,
a sixth electrical contact,
said fifth and sixth electrical contacts being disposed in a third pole of said circuit breaker and being movable into a CLOSED position and into an OPEN position,
a third externally extending electrical terminal of said circuit breaker electrically connected in said third pole of said circuit breaker, and
fourth molded means for physically engaging said fifth contact and for locating said fifth contact spaced apart from said third contact by a distance less than the spacing between said second and third terminals, said fourth molded means for physically engaging and locating said fifth contact comprising a fourth integrally formed portion of said case,
said fifth contact including fifth and sixth components movable relative to each other in the direction of said third and fourth contacts, said fifth component being configured for movement relative to said sixth component in the direction of said third and fourth contacts as a result of the physical engagement of said fifth component by said fourth integrally formed portion of said case.

9. A polyphase electrical circuit breaker as recited in claim 8 wherein said fourth integrally formed portion of said case includes a fourth sloped portion for physically engaging said fifth component to enable said movement between said fifth and sixth components in the direction of said third and fourth contacts.

10. A polyphase electrical circuit breaker as recited in claim 8 wherein said molded case comprises a molded top portion and a separate molded bottom portion, said first, second, third and fourth integrally formed portions of said case respectively comprising first, second, third and fourth integrally formed portions of said molded bottom portion.

11. A polyphase electrical circuit breaker comprising
a first pole of said polyphase circuit breaker,
a second pole of said polyphase circuit breaker, said first and second poles being adjacent poles in said circuit breaker, first and second separable electrical contacts disposed in said first pole and movable into a CLOSED position and into an OPEN position, a first external electrical terminal of said circuit breaker disposed in said first pole, third and fourth separable electrical contacts disposed in said second pole and movable into a CLOSED position and into an OPEN position, a second external electrical terminal of said circuit breaker disposed in said second pole, said first and second separable electrical contacts being spaced from said third and fourth separable electrical contacts by a first distance less than a second distance between said first and second external electrical terminals, a molded case for said circuit breaker comprising a molded top portion and a molded base portion, and positioning means integrally formed in said base portion for maintaining said first contact spaced apart from said third contact by said first distance, said positioning means comprising first elongated molded projecting means in said first pole for physically contacting a first component of said first electrical contact and for moving said first component relative to a second component of said first electrical contact in the direction of said second pole.

12. A polyphase electrical circuit breaker as recited in claim 11 wherein said first projecting means includes a first sloped portion for physically contacting and moving said first component relative to said second component.

13. A polyphase electrical circuit breaker as recited in claim 11 wherein said positioning means further comprises second and third, spaced apart, elongated molded projecting means in said second pole for locating a third component of said third contact in said second pole at said first distance from said first component, said third component being movable with respect to a fourth component of said third contact in the direction of said first pole.

14. A polyphase electrical circuit breaker as recited in claim 11 wherein said second component includes means for physically engaging said first component to limit the movement of said first component in the direction of said second pole.

15. A polyphase electrical circuit breaker as recited in claim 11 further comprising a third pole of said circuit breaker, said second and third poles being adjacent poles in said circuit breaker, fifth and sixth separable electrical contacts disposed in said third pole and movable into a CLOSED position and into an OPEN position, a third external electrical terminal of said circuit breaker disposed in said third pole and an elongated molded projection integrally formed in said base portion in said third pole for maintaining said fifth contact spaced apart from said third contact by a third distance less than a fourth distance between said second and third terminals.

16. A polyphase electrical circuit breaker as recited in claim 15 wherein said first and third distances are nominally the same and wherein said second and fourth distances are nominally the same.

17. A molded case for a polyphase electrical circuit breaker comprising a molded top portion and a separate molded base portion, said base portion including means for locating a first component of a first electrical contact of a first pair of first and second separable electrical contacts for disposition in a first pole of said circuit breaker spaced apart by a first distance from a second component of a third electrical contact of a pair of third and fourth separable electrical contacts for disposition in a second pole of said circuit breaker and means for positioning a first external electrical terminal for making an external electrical connection to said first electrical contact spaced apart from a second external electrical terminal for making an external electrical connection to said third electrical contact by a second distance, said second distance being greater by a predetermined amount than said first distance, said locating means including molded means integrally formed in said base portion for physically engaging said first component, said molded means comprising molded means for physically engaging said first component and for moving said first component relative to another component of said first contact to establish said first distance between said first component and said second component.

18. A molded case for a polyphase electrical circuit breaker as recited in claim 17 wherein said molded means comprises an elongated projection integrally formed in said base portion having an elongated side portion for limiting the movement of said first component in a direction away from said second component and having a sloped portion for physically engaging said first component to move said first component with respect to said another component in the direction of said second component.

19. A polyphase electrical circuit breaker comprising a first electrical contact, a second electrical contact, a third electrical contact, a fourth electrical contact, said first and second electrical contacts being disposed in a first pole of said circuit breaker and being movable into a CLOSED position and into an OPEN position, said third and fourth electrical contacts being disposed in a second pole of said circuit breaker and being movable into a CLOSED position and into an OPEN position, a first externally extending terminal of said circuit breaker electrically connected in said first pole of said circuit breaker, a second externally extending electrical terminal of said circuit breaker electrically connected in said second pole of said circuit breaker, a molded case for housing said circuit breaker and positioning means for locating said first and third contacts spaced apart by a distance different by a predetermined amount from the spacing between said first and second terminals, said positioning means comprising molded means for physically engaging said first contact, said molded means comprising an integrally formed portion of said case, said first contact including first and second components movable relative to each other as the result of the physical engagement of said first component by said integrally formed portion of said case, said positioning means further comprising second molded means for physically engaging said third contact, said second molded means comprising a second integrally formed portion of said case.

20. A polyphase electrical circuit breaker comprising a first pole of said polyphase circuit breaker, a second pole of said polyphase circuit breaker, said first and second poles being adjacent poles in said circuit breaker, first and second separable electrical contacts disposed in said first pole and movable into a CLOSED position and into an OPEN position, a first external electrical terminal of said circuit breaker disposed in said first pole, third and fourth separable electrical contacts disposed in said second pole and movable into a CLOSED position and into an OPEN position, a second external electrical terminal of said circuit breaker disposed in said second pole, said first and second separable electrical contacts being spaced from said third and fourth separable electrical contacts by a first distance different by a predetermined amount from a second distance between said first and second external electrical terminals, a molded case for said circuit breaker comprising a molded top portion and a molded base portion, and positioning means integrally formed in said base portion for maintaining said first contact spaced apart from said third contact by said first distance, said positioning means comprising first elongated molded projecting means in said first pole for physically contacting a first component of said first electrical contact and for moving said first component relative to a second component of said first electrical contact.

21. A polyphase electrical circuit breaker as recited in claim 20 wherein said first projecting means includes a first sloped portion for physically contacting and moving said first component relative to said second component.

22. A polyphase electrical circuit breaker as recited in claim 21 wherein said positioning means further comprises a second elongated molded projecting means in said second pole for locating a third component of said third contact in said second pole at said first distance from said first component.

23. A molded case for a polyphase electrical circuit breaker comprising a molded top portion and a separate molded base portion, said base portion including means for locating a first component of a first electrical contact of a first pair of first and second separable electrical contacts for disposition in a first pole of said circuit breaker spaced apart by a first distance from a second component of a third electrical contact of a pair of third and fourth separable electrical contacts for disposition in a second, adjacent pole of said circuit breaker and means for positioning a first external electrical terminal for making an external electrical connection to said first electrical contact spaced apart from a second external electrical terminal for making an external electrical connection to said third electrical contact by a second distance, said second distance being different by a predetermined amount from said first distance, said locating means including molded means integrally formed in said base portion for physically engaging said first component, said molded means comprising an elongated projection integrally formed in said base portion having an elongated side portion for limiting the movement of said first component relative to said second component and having a sloped portion for physically engaging said first component to move said first component with respect to another component of said first contact.

24. A polyphase electrical circuit breaker comprising a first electrical contact having a first contact arm fixedly secured on a first rotatable pin and having a first stationary member, said first pin being biased into physical and electrical contact with said first stationary member and being movable with respect to said first stationary member laterally along the axis of rotation of said first pin, a second electrical contact, a third electrical contact having a second contact arm fixedly secured on a second rotatable pin and having a second stationary member, said second pin being biased into physical and electrical contact with said second stationary member and being movable with respect to said second stationary member laterally along the axis of rotation of said second pin, a fourth electrical contact, said first and second electrical contacts being disposed in a first pole of said circuit breaker and being movable into a CLOSED position and into an OPEN position, said third and fourth electrical contacts being disposed in a second pole of said circuit breaker and being movable into a CLOSED position and into an OPEN POSITION, a first externally extending terminal of said circuit breaker electrically connected in said first pole of said circuit breaker, a second externally extending electrical terminal of said circuit breaker electrically connected in said second pole of said circuit breaker, a molded case for housing said circuit breaker and positioning means for locating said first and second contact arms spaced apart by a distance different by a predetermined amount from the spacing between said first and second terminals, said positioning means comprising molded means for physically engaging said first pin, said molded means comprising a first integrally formed molded projection in said case.

25. A polyphase electrical circuit breaker as recited in claim 24 wherein said positioning means further comprises second and third molded means for physically locating said second contact arm centered in said second pole, said second and third molded means respectively comprising second and third integrally formed molded projections in said case.

26. A polyphase electric circuit breaker as recited in claim 25 wherein said first molded projection includes a first sloped portion for physically engaging said first pin and for moving said first pin laterally with respect to said first stationary member.

27. A polyphase electrical circuit breaker as recited in claim 26 further comprising a fifth electrical contact having a third contact arm fixedly secured on a third rotatable pin and having a third stationary member, said third pin being biased into physical and electrical contact with said third stationary member and being movable with respect to said third stationary member laterally along the axis of rotation of said third pin, a sixth electrical contact, said fifth and sixth electrical contacts being disposed in a third pole of said circuit breaker and being movable into a CLOSED position and into an OPEN position, a third externally extending electrical terminal of said circuit breaker electrically connected in said third pole of said circuit breaker, and fourth molded means for physically engaging said third contact arm and for locating said fifth contact arm spaced apart from said second contact arm by a distance different by a predetermined amount from the spacing between said second and third terminals, said fourth molded means comprising a fourth integrally formed molded projection in said case.

28. A polyphase electrical circuit breaker as recited in claim 27 wherein said molded case comprises a molded top portion and a separate molded bottom portion, said first, second, third and fourth molded projections respectively comprising first, second, third and fourth integrally formed molded projections in said molded bottom portion.

29. A polyphase electrical circuit breaker as recited in claim 28 wherein said distance between said first and second contact arms is less than said spacing between said first and second terminals and wherein said distance between said second and third contact arms is less than said spacing between said second and third terminals.

* * * * *